United States Patent [19]

Ward et al.

[11] 4,161,554

[45] Jul. 17, 1979

[54] METHOD FOR PREVENTING POLYMERS FORMATION IN STYRENE STORAGE CONTAINERS

[75] Inventors: John K. Ward; Johnny B. Gardner, both of Lake Jackson, Tex.

[73] Assignee: The Dow Chemical Company, Midland, Mich.

[21] Appl. No.: 901,170

[22] Filed: Apr. 28, 1978

[51] Int. Cl.[2] ..... B65D 87/34; B65D 81/24

[52] U.S. Cl. ..... 427/239; 427/386; 427/372 B; 427/410; 427/406; 220/470; 206/524.3; 422/4; 422/40; 585/3

[58] Field of Search ..... 427/248 H, 239, 156, 427/386, 372 B; 23/285; 206/524.3

[56] References Cited

U.S. PATENT DOCUMENTS

| | | | |
|---|---|---|---|
| 2,526,567 | 10/1950 | Drake et al. | 260/650 |
| 2,673,817 | 3/1954 | Burns | 427/239 |
| 3,849,179 | 11/1974 | Morningstar | 23/285 |
| 3,988,212 | 10/1976 | Watson et al. | 203/9 |
| 4,061,545 | 12/1977 | Watson et al. | 203/9 |

OTHER PUBLICATIONS

Boundy et al., Styrene, its Polymers, Copolymers and Derivatives, 1952, Reinhold, pp. 21, 150, 151, 204, 205, 697, 714, 758, 760.

Brown, Metal Finishing, Dec. 1968, pp. 58–60, 66.

*Primary Examiner*—Ralph S. Kendall

*Attorney, Agent, or Firm*—A. C. Ancona

[57] ABSTRACT

A protective curable coating containing a polymerization inhibitor, extractable from the cured coating, which is applied to surfaces located above the liquid level of a storage tank containing a polymerizable alkenyl aromatic monomer, e.g., styrene, vinyl toluene, divinyl benzene on which surfaces said monomer tends to condense. The monomer condensing on the surfaces which have been coated extracts some of the inhibitor from the coating and thus polymerization on these surfaces is prevented or substantially restricted.

6 Claims, No Drawings

METHOD FOR PREVENTING POLYMERS FORMATION IN STYRENE STORAGE CONTAINERS

BACKGROUND OF THE INVENTION

Styrene is a useful monomer which polymerizes with itself and with other monomers to form useful materials for fabricating numerous household and industrial articles of manufacture. In shipping or storing the monomer it must be inhibited with one or another known inhibitors. Among these are p-tert.-butylcatechol, hydroquinone, and the methyl ether of hydroquinone. The p-tert-butylcatechol is most commonly employed as a storage inhibitor. It does not however, prevent polymerization of styrene which vaporizes in the space above the bulk liquid styrene and subsequently condenses on surfaces of the tank structure, such as support and reinforcing beams or girders and protruding bolts or rivets. Other structures such as nozzles, flame arrestors, relief valves, and vapor lines also provide condensing surfaces associated with the tank. This condensed material contains little or none of the inhibitor present in the bulk liquid monomer and thus polymerizes on these surfaces, often growing to large stalactite-like accumulations.

This polymer formation fouls the roof structure, vents, nozzles and instrumentation in the tank. It also amounts to a loss of monomer and when the bulk monomer contacts it, it dissolves in the monomer, resulting in a reduction of quality of the monomer. Before such monomer can be used or sold it must be purified to remove the polymer.

Various methods have been tried for minimizing the problem of the polymerization of the condensate. The tank roof has been painted to provide a less adherent surface and to cause the condensate to run off more rapidly into the liquid which contains inhibitor. Tanks have been built with minimal internal roof support structures. Heat has been applied to nozzles and vapor lines to prevent condensation.

At present the best solutions to the problem as practiced by the industry include painting the tank interior roof and eliminating internal support structures. None of these has proven entirely satisfactory.

It would be highly desirable to find a way in which the condensing monomer in large storage tanks and associated structures could be prevented from polymerizing on the insides of such tanks and structures.

It has now been discovered that if certain inhibitors are added to a coating used to cover these internal tank surfaces, they will be leached out by the condensed monomer and prevent the polymerization of the monomer on the internal surfaces of the tank.

DETAILED DESCRIPTION OF THE INVENTION

Certain inhibitors, known to be useful in preventing polymerization of styrene monomer, have been incorporated into a paint or protective coating to be applied to surfaces and structures exposed to vapors of the styrene monomer. The structures and surface thus coated will not be subject to the growth of polymer. Various epoxy-type paints may be employed to which the inhibitors can be added. Other coating materials from which the inhibitor is extractable by the condensed monomer may also be employed.

Some compounds known to inhibit the polymerization of styrene are tert-butylcatechol (TBC), hydroquinone (HQ) and, the methyl ether of hydroquinone (MEHQ); elemental sulfur has also been employed. Any of the above or others may be employed in the coatings used to cover internal surfaces of tanks in which styrene is stored.

Coatings which contain epoxy resins are especially good for the purpose. Paints containing bisphenol-derived epoxies such as Phenoline 372, made by Carboline Manufacturing Co., and Chempon 2310R, made by Plaschem Co., are representative of epoxy paints to which the inhibitors may be added according to the invention.

Yet other coating materials which can be used are certain inorganic based materials. Representative of these is zinc metal dispersed in a silicate binder. Such a product is sold by the above mentioned Carboline Manufacturing Co., under the tradename Carbozinc SP 76X.

Solvents preferred as carriers for the inhibitors are the lower alkanols, although any solvent compatible with the coating compositions and inert to the components is useful. Water can be used with water-based zinc-silicate coatings while alcohols, such as methanol, can be used with the organic solvent-containing epoxy paints. The inhibitor may be added as a powder to the coating formulation rather than from a solution of the inhibitor. However, the leaching of the inhibitor from the cured coating is slower when added as a powder than when the inhibitor was added as a solution. For the purposes of this invention an effective amount of inhibitor is considered to be an amount of from about 0.1% to about 40% by weight based on the total weight of solids and inhibitor in the coating material. A preferred amount is at least 1% inhibitor and most preferred is at least 5% inhibitor in the coating material.

Following is a description of the test method used to determine the leachability of the inhibitor from the coating:

A one-gallon cylindrical can was used as a miniature model of a tank and a wire structure simulating the supports and braces in a large tank was attached to the inside of the lid. Wires attached to the outside edge of the lid radiated inwardly to form a cone-shaped structure the apex of which hung down into the can. From this apex was suspended a small beaker to catch the condensate of the styrene which vaporized within the can and condensed on the inside of the lid and wire structure which was coated with the paint containing the inhibitor to be tested. The lower outside of the can was wrapped with electrical resistance tape for heating its contents to provide the vaporization and condensations encountered under actual storage conditions.

In performing the test the can was filled about ⅓ full (about 1 liter) with styrene monomer and it was heated to about 30° C. The lid was fitted loosely.

Approximately 3–4 ml of condensate was collected each day. The lid was examined daily for failure of the paint coating and the condensate was analyzed for the amount of inhibitor which it contained.

EXAMPLE 1

An epoxy paint (Phenoline 372), which was a bisphenol epoxy-based resin coating containing 80% solids, (of which about ¼ was pigment and fillers, the remainder being the resin and hardeners:), and to which 20% by volume of an 85% solution of TBC in methanol had been added, was applied as a coating to the lid and wire structure of a can such as described above. Selected daily analyses of the condensate collected are shown tabularized below:

| | |
|---|---|
| 1st day | 1200 ppm TBC |
| 5th day | 400 ppm TBC |
| 13th day | 240 ppm TBC |

In the above example the inhibitor, although effective, was leached too rapidly to provide a longlasting answer to the problem. Example 2 shows one method which provides a more acceptable slow release of the inhibitor.

EXAMPLE 2

The surface and wire structure of a can were coated with a first coat of paint as in Example 1. After this coat had cured a second coat of the same paint, but without the inhibitor was employed as a top-coat. This method provided a slower release, allowing for an effective inhibition over a longer period of time. It is known that 1 ppm of this inhibitor will restrict polymerization sufficiently to prevent solids buildup in bulk monomer. Thus, sufficient inhibitor should be added to the paint to provide this minimum amount in the condensing monomer. The data shown below indicate that this method achieved close to optimum results.

| | |
|---|---|
| 1st day | 5 ppm TBC |
| 5th day | 4 ppm TBC |
| 9th day | 3 ppm TBC |
| 21st day | 2.5 ppm TBC |
| 41st day | 2 ppm TBC |
| 78th day | 2 ppm TBC |
| 90th day | 2 ppm TBC |
| 122nd day | 2 ppm TBC |
| 150th day | 2 ppm TBC |

EXAMPLE 3

Other coatings applied as in Example 2 were also used with the TBC and the results of the tests are shown in the table below:

| Coating | Chempon* 2310R | Carbozinc** SP76X |
|---|---|---|
| 1st day | 175 ppm TBC | 250 ppm TBC |
| 2nd day | 60 ppm TBC | — |
| 5th day | 20 ppm TBC | 200 ppm TBC |
| 6th day | 16 ppm TBC | 240 ppm TBC |
| 8th day | 10 ppm TBC | 200 ppm TBC |

In a control run in which no TBC is added to the paint employed to coat the lid and wire structure polymer formed on the inside surface of the lid to such an extent that the lid was tightly adhered to the can.

| | |
|---|---|
| *Chempon 2310R | A 100% solids epoxy with amine catalyst, 25% pigment. (To this was added 20% TBC as an 85% solution in MeOH). |
| **Carbozinc SP76X | |
| 76% zinc metal<br>24% silicate binder | 50% solids in ethanol. |

EXAMPLE 4

Certain internal structures of a large bulk storage tank employed in a commercial styrene plant to store styrene was painted in the manner of Example 2, but using the paint and inhibitor combination of Example 1. Condensate from the so-painted structure was collected and over a 6-month period a steady concentration of 1–1.5 ppm TBC was found. There was no evidence of polymer solids build-up on the painted internal structures of the tank. The concentration of TBC in the bulk monomer was maintained at 12 ppm.

The above described procedures, while illustrated for storage of styrene monomer, are also applicable to the storage of vinyl toluene, α-methyl styrene, tert-butyl styrene; divinylbenzene, and chlorostyrenes by using the same inhibitors at appropriate levels in paints for coating the interior surfaces of roof structures in storage tanks.

Other inhibitors such as the nitrophenols and nitrosamines are useful for inhibiting polymerization of the monomers enumerated above.

We claim:

1. A method for preventing polymer formation on the surfaces above the vapor space in storage tanks containing polymerizable alkenyl aromatic monomers which comprises covering said surfaces with a protective coating material, selected from the group consisting of epoxy resin-containing and inorganic silicate-containing coatings, which contains an amount of from about 0.1% to about 40% by weight based on total solids of leachable polymerization inhibitor for said monomer.

2. The method of claim 1 wherein the inhibitor is present in an amount of at least about 1%.

3. The method of claim 2 wherein the epoxy resin in said coating is a bisphenol-derived epoxy resin.

4. The method of claim 1 wherein the inhibitor employed is hydroquinone, methyl ether of hydroquinone or p-tert-butyl catechol.

5. The method of claim 4 wherein the film forming inorganic silicate coating contains zinc.

6. The method of any one of claims 1 through 5 wherein a second covering of the protective coating material which contains no inhibitor is applied over the inhibitor-containing coating, said second covering being of a thickness sufficient to permit the leaching of the inhibitor so as to provide at least one ppm inhibitor in the condensed monomer.

* * * * *